United States Patent [19]

Amos

[11] 4,057,196

[45] Nov. 8, 1977

[54] APPARATUS AND METHOD FOR WINDING YARN ON A BOBBIN

[75] Inventor: James W. Amos, Siluria, Ala.

[73] Assignee: Canton Textile Mills, Inc., Canton, Ga.

[21] Appl. No.: 756,487

[22] Filed: Jan. 3, 1977

[51] Int. Cl.[2] ..... B65H 54/02

[52] U.S. Cl. ..... 242/18 PW

[58] Field of Search ..... 242/18 PW, 18 A, 18 R, 242/125.1

[56] References Cited

U.S. PATENT DOCUMENTS

| | | | |
|---|---|---|---|
| 3,741,488 | 6/1973 | Wuest | 242/18 PW |
| 3,942,731 | 3/1976 | Lattion | 242/18 PW |
| 3,952,959 | 4/1976 | Shaw | 242/18 PW |

*Primary Examiner*—Edward J. McCarthy

*Attorney, Agent, or Firm*—Walter M. Rodgers; Walter A. Rodgers

[57] ABSTRACT

A running yarn is severed from a completed yarn package and inserted into yarn collecting means and an empty bobbin having end slots is manipulated to cause the running yarn to occupy the end slots and is then placed in position on a pair of supporting arms which in turn are moved toward driving means while simultaneously a control guide mounted on one of the bobbin supporting arms is manipulated manually from a normal position to an operated position of engagement with the running yarn and held in an operated position while the empty bobbin is rotated sufficiently so as to form a reserve winding at one end of the bobbin following which the yarn control guide is released and caused to swing aside so as to allow reciprocable guide means to engage the running yarn and to cause the yarn to wind evenly on the bobbin from a point adjacent the running winding to a point adjacent the other end.

7 Claims, 8 Drawing Figures

APPARATUS AND METHOD FOR WINDING YARN ON A BOBBIN

Known means for use primarily in conjunction with open end spinning apparatus includes yarn feed means arranged to feed a running winding to a bobbin which when filled is removed and the running yarn severed following which the severed running yarn is collected by yarn collecting means. An empty bobbin having a pair of slots in one end is then manipulated so as to receive the running winding in the slots and is thereafter mounted in its normal position between a pair of bobbin supporting arms. In order to establish a reserve winding at one end of the bobbin, a fixed guide is mounted adjacent one end of the bobbin and is arranged to guide the yarn from the yarn collecting means onto a groove formed in one end of the bobbin. Simultaneously reciprocable guide means engages the part of the running yarn from the yarn feed means and causes such portion of the running yarn to wind evenly from end to end from a position spaced slightly from the slot in one end to the opposite end of the bobbin so as to cause the bobbin to fill evenly. Since the reserve winding is formed from yarn withdrawn from the yarn collecting means and guided by a fixed guide into the reserve winding groove, it frequently happens when this so-called tail is cut, the free end is lodged onto the part of the bobbin on which the reciprocable guide means is in the process of applying yarn evenly. When this happens and after the package is completed and removed from the spinning frame, it is impossible for an operator precisely to identify the free end or tail for use in interconnecting the finished package with another finished package for continuous processing in a subsequent operation. More precisely, if the looped part of the reserve winding which protrudes from the end of the finished completed main part of the package is severed, there is no means by which an operator can determine which severed end forms a continuous reserve winding or which is simply a fragment of an uncontrolled tail which was enmeshed within the package.

According to this invention in one form as applied to an open end spinning apparatus, a reserve winding is formed primarily from the running winding supplied by the feed means rather than from that part of the running winding which is fed into the yarn collecting means and this is accomplished by mounting on one of the bobbin supporting arms, a yarn control guide which is movable manually from a normal position to an operated position at which yarn from the yarn feed means is guided precisely into a reserve groove formed at one end of the empty package and is held at an adequate clearance distance from automatically reciprocable yarn guide means which automatically engages the yarn if not controlled and feeds it evenly from one end of the package to the other. After a number of revolutions of the empty bobbin, the portion of the yarn which extends into the yarn collecting means is simply severed and after a few more revolutions, the severed end is held in the reserve winding by the running yarn whereupon the control guide is released to allow the automatically reciprocable yarn guide to engage the running yarn and to apply it to the package in the normal manner without causing the "free end" of the running winding to become entrapped and covered by subsequently applied layers of yarn under the control of the automatic reciprocable yarn guide means so that upon completion of the package, a readily accessible "tail" is available for connection to another completed package for subsequent processing on a continuous basis.

For a better understanding of the invention, reference may be had to the following detailed description taken in conjunction with the accompanying drawings in which.

Figure 1:
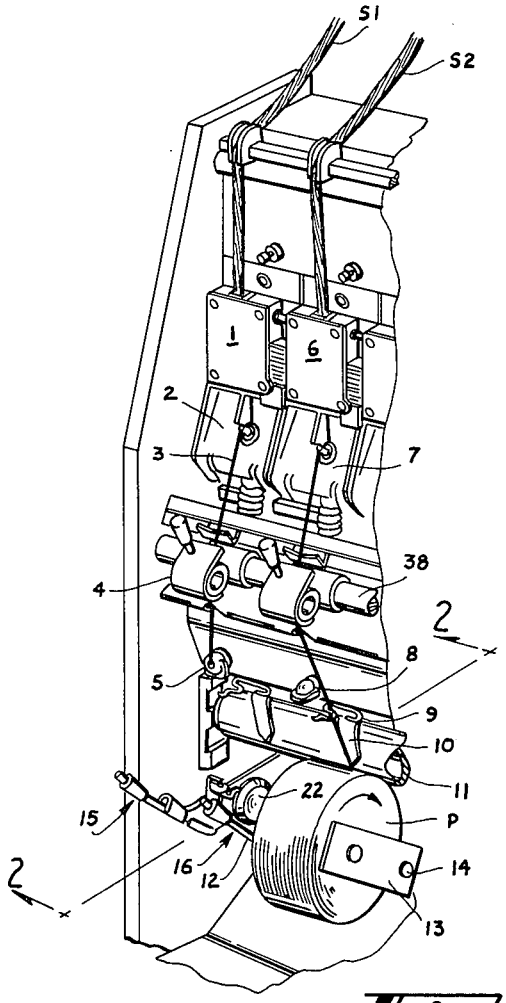
FIG. 1 is a perspective view of one end of an open end spinning frame and which shows a yarn package in the process of being wound and which shows support arms from which a completed package has been removed and in which the running yarn is being supplied from yarn feed means into yarn collecting means as a preliminary step prior to mounting an empty bobbin in place for winding.
Figure 3:
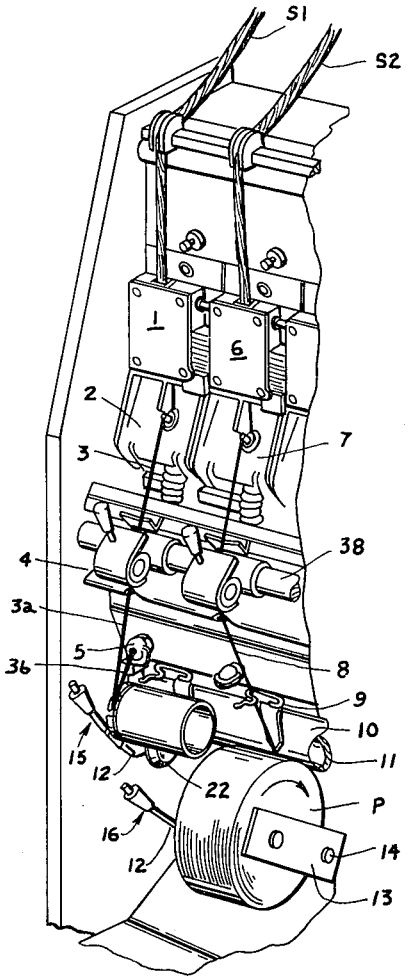
FIG. 3 is a view similar to FIG. 1 but which depicts a subsequent stage in mounting of an empty bobbin by causing the running yarn from the yarn feed means to pass through a pair of slots formed in one end of the bobbin.
Figure 2A:
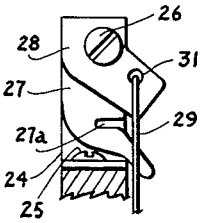
FIG. 2A is a view taken along the line designated 2A—2A in FIG. 2 and which shows the control guide in its normal unoperated position.
Figure 4:
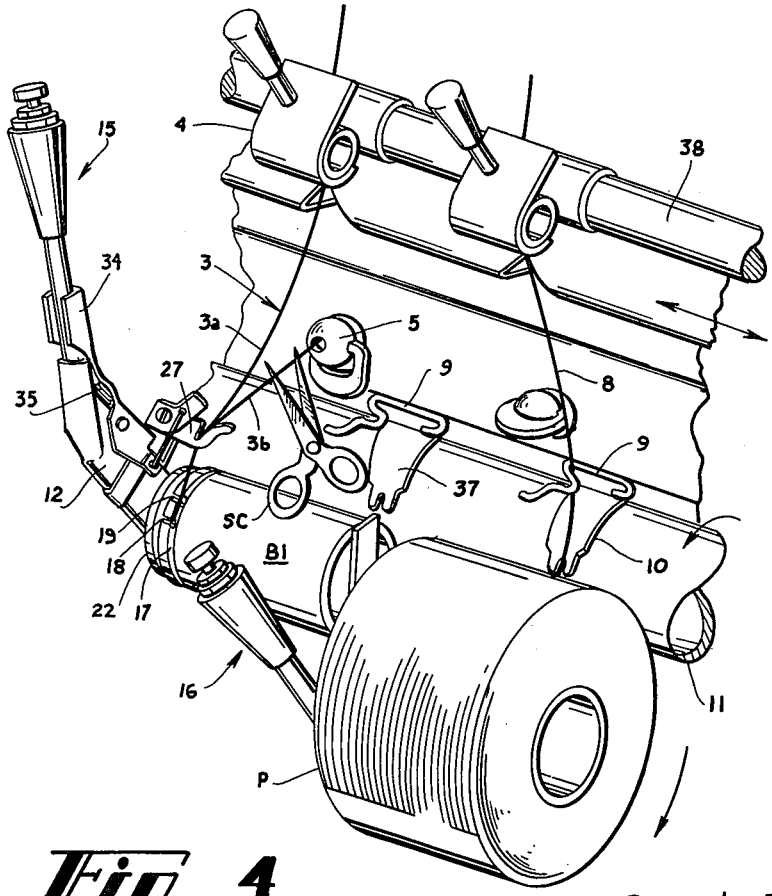
Figure 5:
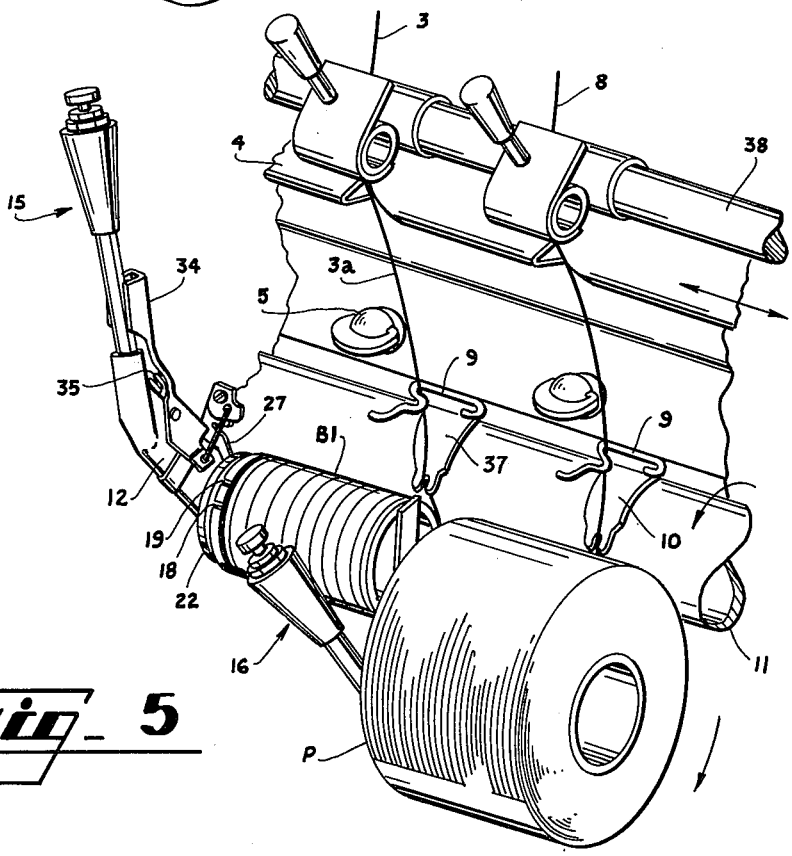

FIG. 4 is a view similar to FIGS. 1 and 3 but which represents a stage subsequent to that represented in FIG. 3 during which a reserve winding is being formed at one end of the bobbin and which is primarily being formed from the running yarn from the yarn feed means and in which FIG. 5 depicts a stage which is subsequent to that represented in FIG. 4 and at which the yarn control guide is released to the position represented in FIG. 2A and at which position automatic yarn guide means may engage the running yarn from the yarn feed means and automatically apply the yarn evenly along the length of the bobbin between a point adjacent the reserve winding at one end and a point adjacent the opposite end of the bobbin.

In FIG. 1 a sliver S1 is shown being fed into feeding device 1 and from the feeding device into spinning device 2 from which running yarn 3 is fed through feed means 4 in the form of delivery rolls into yarn collecting means 5 which may simply constitute an open vacuum conduit of known construction. As is well understood, running yarn 3 is retained in the position shown by yarn collecting means 5 during the doffing of a completed package and the mounting and interconnection of an empty bobbin with the running yarn 3.

Also represented in FIG. 1 is a sliver S2 which is shown being supplied to feed means 6 and from the feed means into spinning device 7 from which running yarn 8 is supplied to feed means 38 which is in the form of delivery rolls from whence the running yarn 8 is supplied through fixed guide 9 and automatically reciprocable yarn guide 10 which operates in known manner to cause the running yarn 8 to be applied evenly from end to end of the package P. Rotation is imparted to package P in a clockwise direction as viewed in FIG. 1 by means of a rotatable roll 11 due to frictional contact therewith. Package P is mounted on support arms 12 and 13 which are pivotally mounted at 14 and which are biased for movement about shaft 14 in a clockwise direction as viewed in FIG. 1. FIG. 1 also depicts supporting arm 15 and its associated supporting arm 16 in the positions which these parts occupy following the doffing of a completed package from the support arms 15 and 16. This doffing operation as is well known is accompanied by severing the yarn formed on the package from the running yarn 3 and the subsequent insertion of the severed end of running yarn 3 into yarn collecting means 5 so that FIG. 1 represents the condition of the mechanism following doffing of a package from arms 15 and 16 and before the insertion of an empty bobbin thereon and the establishment of an operative interrelationship with the running yarn 3.

Figure 3A:
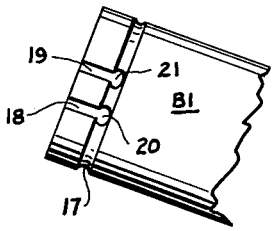
FIG. 3A is an enlarged view of one end of an empty bobbin which shows the yarn receiving slots and the reserve winding groove formed in the bobbin.

FIG. 3 depicts the stage of mounting an empty bobbin B1 in place and depicts the interrelationship between the running yarn 3 and the bobbin B1. As is shown in FIG. 3A, bobbin B1 is provided with a peripheral groove 17 and a pair of end slots 18 and 19 which at their inner ends communicate with apertures 20 and 21.

In order to mount an empty bobbin on arms 15 and 16, an operator grasps a bobbin such as B1 and manipulates it with respect to the running winding 3 so as to cause the running winding from feed means 4 to enter slot 18 through the interior of the bobbin and to cause the running winding to move into slot 19 and thence into the yarn collecting means 5. After this step is performed, the parts occupy the positions depicted in FIG. 3. The procedure described thus far is in accordance with known practice.

Figure 2:
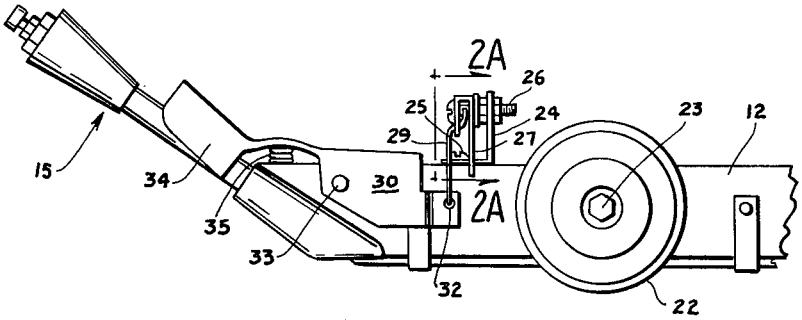
FIG. 2 shows a side view generally taken along the line designated 2—2 in FIG. 1 of a bobbin support arm to which a control guide and its associated operating arm and linkage are mounted according to this invention.
Figure 2B:
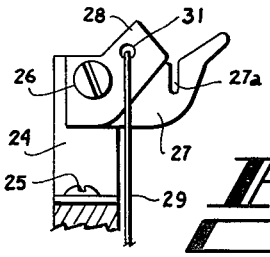
FIG. 2B is a view similar to FIG. 2A but which shows the yarn control guide in its yarn engaging or operated position.

In order to insure that a reserve winding with a readily accessible "tail" or end is formed in the reserve winding groove 17, apparatus formed according to this invention is employed and is best shown in FIGS. 2, 2A and 2B. As shown in FIG. 2, operating arm 15 is provided with a conventional flanged roller 22 which is rotatable about a pin 23 rigidly affixed to arm 15. This roller receives an end of a bobbin such as B1 which is the end depicted in FIG. 3A, i.e. the end adjacent slots 18 and 19, the apertures 20, 21 and the groove 17. A bracket 24 is rigidly mounted to bobbin supporting arm 15 by screw 25 and is provided with a bolt 26 on which a yarn control guide 27 is pivotally mounted. An arm 28 is rigidly secured to yarn control guide 27 and is interconnected by a link 29 with one end of operating arm 30. Link 29 is inserted into an aperture 31 formed in element 28 and is inserted into an aperture 32 formed in operating arm 30. Operating arm 30 is pivoted at 33 to bobbin support arm 15 and is provided with a manually engageable part 34 and a compression spring 35 which serves to bias operating arm 30 in a clockwise direction about its pivot 33 as viewed in FIG. 2. When biased by compression spring 35 to the position represented in FIG. 2A, the yarn control guide 27 is disposed in its so-called normal position. Manual engagement of manually engageable handle 34 and pressure thereon which tends to compress spring 35 imparts counterclockwise rotation to operating arm 30 about its pivot 33 and causes the link 29 to move bodily upward and in turn causes arm 28 and yarn control guide 27 to swing in a counterclockwise direction about bolt 26 as viewed in FIG. 2B to occupy the positions shown in that figure at which positions the parts are disposed to engage the running yarn 3 which is being supplied from yarn feed means 5.

Movement of the yarn control guide 27 to the position represented by FIG. 2B insures that the running yarn 3 from the yarn feed means 4 enters slot **27*a* in control guide 27 by which it is held securely in alignment with the peripheral groove 17 of bobbin B1 as best shown in FIG. 4. In addition this action insures that the known reciprocable automatically operable yarn guide 37 cannot engage and gain control of that part of the running yarn 3 which is disposed between the feed means 4 and the bobbin B1. Thus during a brief period while the running yarn 3*a* from feed means 4 and 3*b* into yarn collecting means 5 are being wound for approximately one revolution about the bobbin B1, the guide 37 cannot engage the part 3*a* of the running yarn because of the control thereof by the yarn control guide 27 when the parts are in the positions represented in FIG. 4. Under these conditions, the part of the running yarn 3*b* which extends from bobbin B1 into the yarn collecting means 5 is severed as represented in FIG. 4 by manually operable scissors SC. Following severance of the yarn 3*b*, the operating arm 30 is held in its operated position as shown in FIG. 4 until several revolutions of the bobbin B1 take place and which are sufficient to capture the severed end of the part 3*b* of the running yarn as a part of the reserve winding accumulated in peripheral groove 17. Once this action is completed, the manual operating element 34 is released to allow the compression spring 35 to swing the operating arm 30 in a clockwise direction about pin 33 as viewed in FIG. 2 and in turn to swing the arm 28 and the yarn control guide 27 in a clockwise direction as viewed in FIGS. 2A and 2B and into the normal position represented in FIG. 2A. When in this position, the groove 27*a* in yarn control guide 27 is completely clear of the running yarn 3*a* supplied from the yarn supply means 4 to the bobbin B1. With the parts in the positions as described and as represented for example in FIG. 5, reciprocable guide 37 automatically engages the running yarn 3*a* and proceeds to apply the yarn normally to the bobbin B1 from a point on the bobbin adjacent the reserve winding in groove 17** to a point adjacent the opposite or right hand end of the bobbin as viewed in the drawings and which operation is in accordance with conventional well known practice.

It is apparent that the free end of the severed part of the running winding **3*b* is precluded from becoming intertwined and overwrapped by running yarn 3*a* applied to the bobbin B1 by the automatic guide 37 because it is secured in groove 17 by subsequent turns of running yarn 3*a*. Thus when the package on bobbin B1 is completed, it may be doffed in the usual manner and an operator may find certain and ready access to the free "tail" according to this invention. Such uniform results are not achievable by the known apparatus and methods which form the reserve winding or "tail" from the part 3*b* of the running winding 3 which is drawn from yarn collecting means such as 5 rather than from the part 3*a* of the running yarn 3 which is drawn from the yarn feed means 4** according to this invention.

The embodiments of the invention in which an exclusive property or privilege is claimed are defined as follows:

1. Apparatus for winding yarn on an empty bobbin so as to form a reserve winding having an accessible end at one end of the bobbin, said apparatus comprising yarn feed means for continuously feeding a running yarn, yarn collecting means for receiving and collecting a running yarn fed by said yarn feed means, a pair of pivotally mounted spaced apart bobbin supporting arms each having a bobbin supporting flanged roller rotatably mounted thereon for respectively engaging the ends of a bobbin having axially extending angularly spaced slots formed in one end thereof and extending inwardly by a distance farther than the distance by which the associated roller projects into the bobbin so that yarn from said yarn feed means may pass inwardly through one of said slots and outwardly through the other of said slots, means for rotating the bobbin, a reciprocable guide disposed to receive the running yarn from said yarn feed means and effective to cause the yarn to wind evenly along the bobbin, and a yarn control guide movably mounted on one of said bobbin supporting arms and movable from a normal position to a position of engagement with the running yarn from said yarn feed means so as to hold the running yarn clear of said reciprocable guide in order to form a reserve winding having an accessible end at one end of the bobbin.

2. Apparatus according to claim 1 wherein said yarn control guide is pivotally mounted on said one bobbin supporting arm and arranged to swing in a plane which is transversely disposed relative to said one bobbin supporting arm.

3. Apparatus according to claim 1 wherein said yarn control guide is biased toward its normal position on said bobbin supporting arm.

4. Apparatus according to claim 1 wherein a manually operable pivotally mounted operating arm is mounted on said one bobbin supporting arm and interconnected by linkage means with said yarn control guide.

5. Apparatus according to claim 4 wherein spring means acting between said manually operable operating arm and said bobbin supporting arm is arranged to bias said manually operable operating arm toward a position corresponding with the normal position of said yarn control guide.

6. Apparatus according to claim 1 wherein a yarn receiving slot is formed in said yarn control guide and wherein said slot is disposed in a plane which is transverse to the axis of the bobbin and wherein said slot is spaced transversely somewhat from said one end of the bobbin and from the path of reciprocation of said reciprocable guide so as to cause the reserve winding to remain clear of the path of travel of said reciprocable guide when said yarn control guide is disposed in its position of engagement with the running yarn from said yarn feed means.

7. A method of winding yarn on an empty bobbin having yarn receiving slots at one end so as to form a reserve winding having an accessible end at said one end of the bobbin, the method comprising feeding a running yarn into yarn collecting means, threading the running yarn through the slots in the bobbin, mounting the threaded bobbin on a pair of spaced apart bobbin supporting arms, rotating the bobbin, engaging the running yarn being fed into said collecting means and holding the running yarn in a position of transverse alignment with a part of the bobbin which is near said one end thereof so as to cause the running end to form a reserve winding thereon; cutting the running end of yarn being fed into said yarn collecting means to form an untangled tail, disengaging the running yarn being wound on the bobbin, and finally winding the running yarn on the bobbin by causing the yarn to wind evenly along a part of the bobbin spaced axially from the reserve winding.

* * * * *